United States Patent [19]

Smith

[11] Patent Number: 4,654,612

[45] Date of Patent: Mar. 31, 1987

[54] SPRING HANGER SYSTEM FOR UHF CIRCULAR WAVEGUIDE HAVING GLIDE RING AND CLAMPING RING CONNECTED BY CONSTANT FORCE SPRINGS

[75] Inventor: Richard D. Smith, Lakewood, Calif.

[73] Assignee: Andrew Corporation, Orland Park, Ill.

[21] Appl. No.: 683,004

[22] Filed: Dec. 18, 1984

[51] Int. Cl.[4] ..... H01Q 1/12

[52] U.S. Cl. ..... 333/248; 343/890; 343/891; 248/59; 248/62; 248/74.1

[58] Field of Search ..... 333/248, 259; 343/890, 343/891, 874, 905; 248/49, 58, 59, 62, 65, 219.4, 565, 539–541, 310, 311.2, 315, 74.1, 68.1; 285/61; 52/40, 110, 111

[56] References Cited

U.S. PATENT DOCUMENTS 2,708,686 5/1955 Bernard, Jr. et al. ..... 343/890 X 4,342,474 8/1982 Sewell et al. ..... 343/891 X

OTHER PUBLICATIONS

Andrew's Corp. Products catalog; 1955 edition, p. 70, "Transmission Line Hangers", item 13889.

*Primary Examiner*—Eugene R. LaRoche

*Assistant Examiner*—Benny T. Lee

*Attorney, Agent, or Firm*—Leydig, Voit & Mayer

[57] ABSTRACT

A spring hanger system for supporting a UHF circular waveguide from a transmission tower and including a plurality of vertically spaced spring hangers, each adapted to engage an adjacent section in the vertical run of waveguide in the tower. Each hanger includes a glide ring fixed to the tower for restraining the waveguide from movement in any direction except vertical; a clamping ring spaced axially below the glide ring which is adapted to grip the outer periphery of the waveguide snugly without distorting same, whereby the waveguide is stiffened against deformation by lateral forces in the region of the glide ring; and a spring mechanism connecting the glide ring and the clamping ring with a substantially constant force which allows the waveguide to move in response to differential expansion with respect to the tower.

9 Claims, 10 Drawing Figures

SPRING HANGER SYSTEM FOR UHF CIRCULAR WAVEGUIDE HAVING GLIDE RING AND CLAMPING RING CONNECTED BY CONSTANT FORCE SPRINGS

FIELD OF THE INVENTION

The present invention relates to devices for suspending UHF circular waveguides in transmission towers and, more specifically, to a novel spring hanger system interposed between the tower and associated sections of the circular waveguide.

BACKGROUND OF THE INVENTION

As circular waveguides have met with increasing usage in UHF transmission towers, a number of problems have surfaced. A typical transmission tower may vary in height from a few hundred to more than 1500 feet. A vertical run of circular waveguide corresponding to the tower height must be erected and supported in the tower. Since the tower is made of steel and the waveguide is made of aluminum of copper, the waveguide tends to creep axially relative to the tower due to differential expansion accompanying changes in temperature. The waveguide is further subject to severe lateral forces due to wind loading, tending to deform it at the points of support. The likelihood of deformation is increased because the waveguide has a sidewall of relatively soft metal which is extremely thin in relation to its diameter. Such deformation tends to introduce discontinuities into the energy mode transmitted through the waveguide, resulting in ghosting and other abnormalities.

Attempts have been made heretofore to suspend waveguides from transmission towers by means of coil extension springs to compensate for the differential expansion rates between the tower and the waveguide. Such systems have a number of disadvantages. Among these are large hanger size requiring a large distance from the waveguide center line to the hanger mounting surface on the tower, with resulting lack of rigidity; excessive clearance area required in order to accommodate the spring mechanism; attachment to the waveguide only at a flange connection, thereby requiring additional hanger members; critically of aligning during installation to avoid binding of the hanger mechanism; excessive waveguide and hanger wear because of metal to metal contact; possibility of damage to the waveguide from wind load forces; and excessive costs.

Another prior suspension makes use of conventional extension spring type hangers to support the waveguide. This type of suspension also has disadvantages such as variation of spring force with the amount of spring deflection; requirement for excessive length in the spring in its working area; necessity for precluding loss of parts from the transmission tower in event of spring failure; and likelihood of damage to the waveguide from wind load in event of spring failure.

SUMMARY OF THE INVENTION

One object of the present invention is to provide a suspension system for mounting a large sized UHF circular waveguide in a transmission tower in a manner which compensates for changes in length due to differential expansion between the waveguide and the tower while overcoming the disadvantages of prior systems set forth above.

Another object of the invention is to provide a suspension system of the foregoing type for supporting a circular waveguide in a transmission tower in such manner as to preclude deformation of the waveguide when the hanger resists lateral forces caused by wind loading.

A further object of the invention is to provide a suspension system of the character set forth above for supporting a circular waveguide in a transmission tower in a manner which distributes the weight of the waveguide over substantially the entire tower structure rather than concentrating the weight at the top of the tower.

Another object of the invention is to provide a system of hangers of the foregoing type for supporting a circular waveguide in a transmission tower in such a way as to allow vertical motion of the waveguide but restraining all other motion without damaging the waveguide.

Still another object of the invention is to provide a large waveguide suspension system of the foregoing character which will be of simple, economical construction and reliable in operation, utilizing constant force spring devices with their critical portions protected from the weather.

The foregoing objects are accomplished in this instance by providing a plurality of spring hangers each adapted to engage an adjacent section in the vertical run of waveguide in the tower; each hanger comprising a first means fixed to the tower for restraining the waveguide from movement in any direction except vertical; a second means spaced axially from the first means adapted to grip the outer periphery of the waveguide snugly without distorting same, whereby the waveguide is stiffened against deformation by lateral forces in the region of the first means; and a third means for resiliently connecting the first and second means with a substantially constant force.

Other objects and advantages will become apparent as the following description proceeds, taken with the accompanying drawings.

Figure 2:
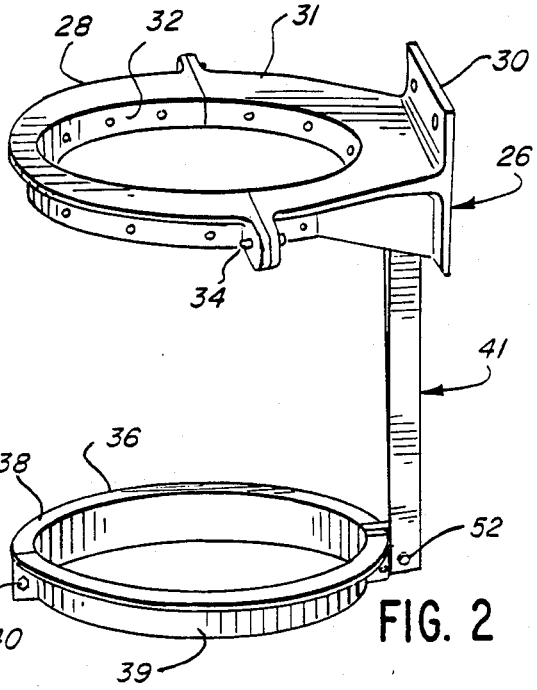
FIG. 2 is a perspective view of an illustrative waveguide hanger embodying the present invention.

While the invention is susceptible of various modifications and alternative constructions, a certain illustrative embodiment has been shown in the drawings and will be described below in considerable detail. It should be understood, however, that there is no intention to limit the invention to the specific form disclosed, but, on the contrary, the intention is to cover all modifications, alternative constructions, and equivalents falling within the scope of the appended claims.

DETAILED DESCRIPTION OF THE INVENTION

Figure 1:
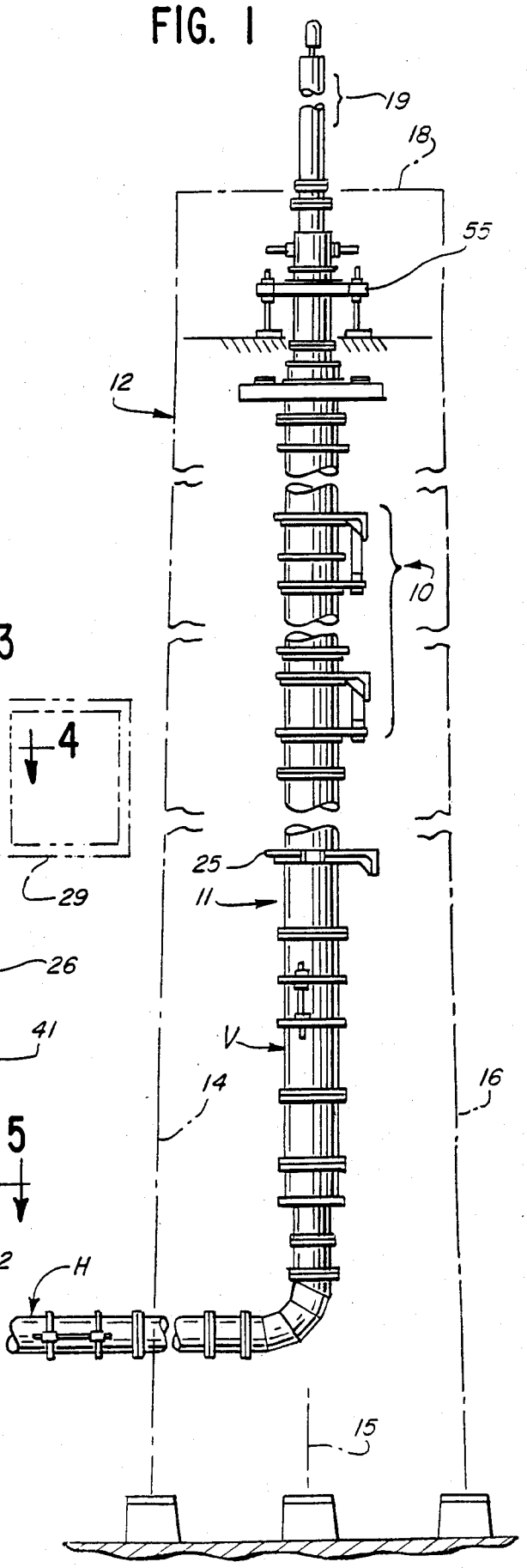
FIG. 1 is an elevational view of a large diameter circular waveguide installed in a transmission tower, the waveguide being shown in broken segments and the tower being shown schematically in corresponding segments for purposes of simplified illustration.
Figure 4:
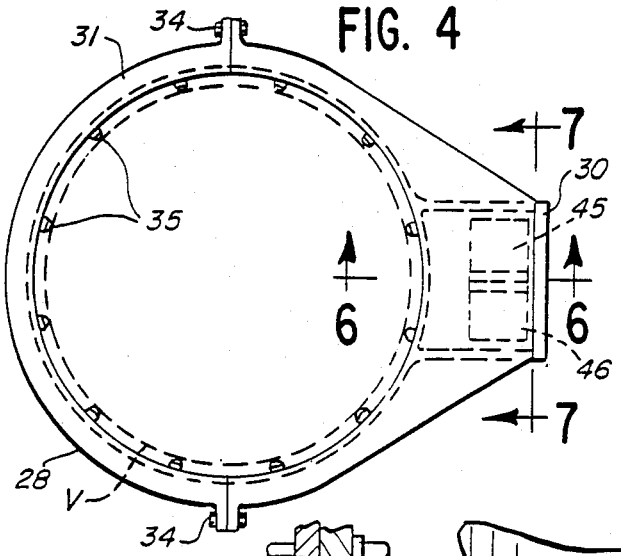
FIG. 4 is a plan view illustrating the glide ring assembly in the waveguide of FIGS. 2 and 3.
Figure 5:
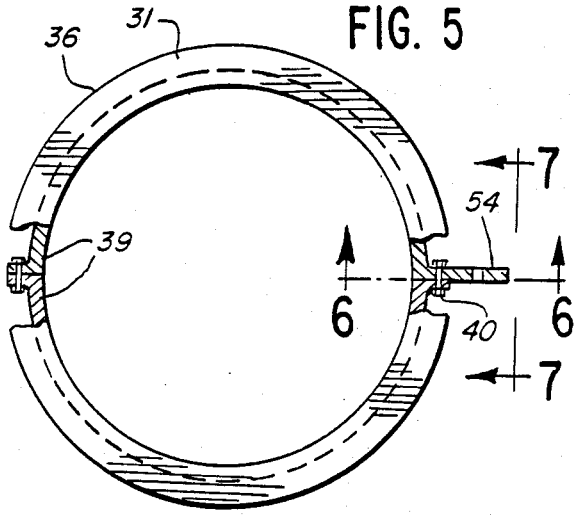
FIG. 5 is a plan view, partly in section, illustrating the clamping ring of the waveguide hanger shown in FIGS. 2 and 3.
Figure 6:
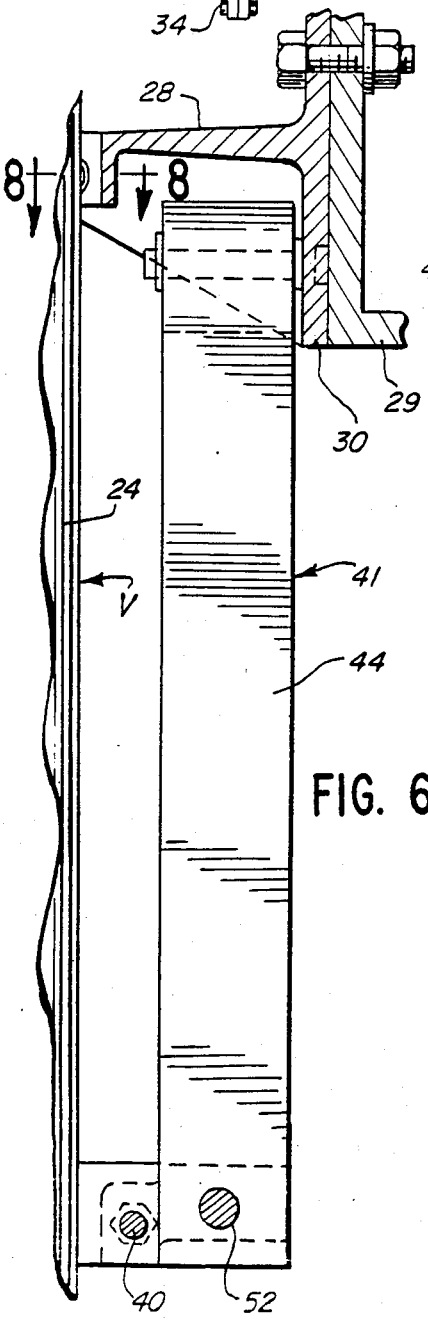
FIG. 6 is an enlarged, fragmentary vertical sectional view through the illustrative waveguide hanger taken in the plane of the lines 6—6 in FIGS. 4 and 5.
Figure 7:
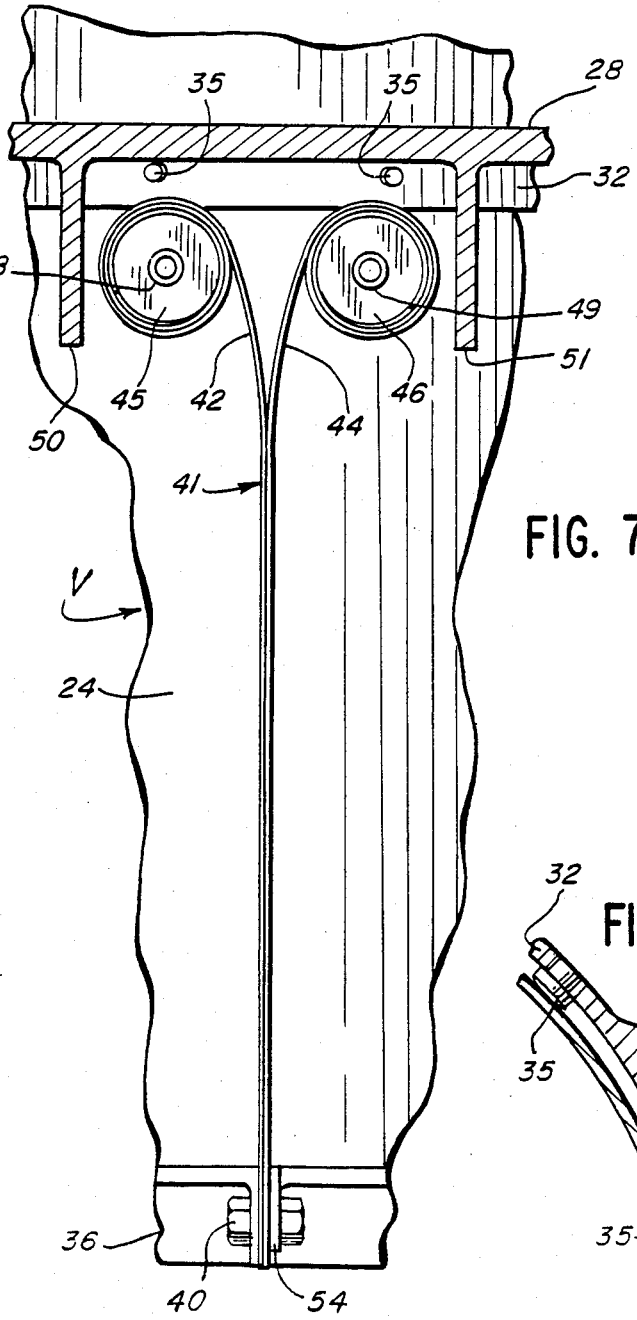
FIG. 7 is an enlarged, fragmentary vertical sectional view taken through the waveguide hanger in the plane of the lines 7—7 in FIGS. 4 and 5.
Figure 8:
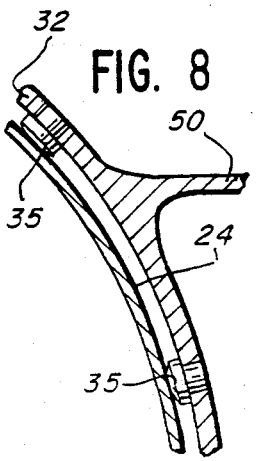
FIG. 8 is a further enlarged, fragmentary, horizontal sectional view taken through the annular skirt of the glide ring shown in FIG. 4 and illustrating the sliding contact arrangement between the glide ring and the outer periphery of the waveguide.

Referring more specifically to FIG. 1, the invention is there exemplified in an illustrative spring hanger system 10 supporting a UHF circular waveguide 11 in a television transmission tower 12. To facilitate illustration, the waveguide is shown in broken segments and the tower is shown diagrammatically in corresponding segments.

Figure 3:
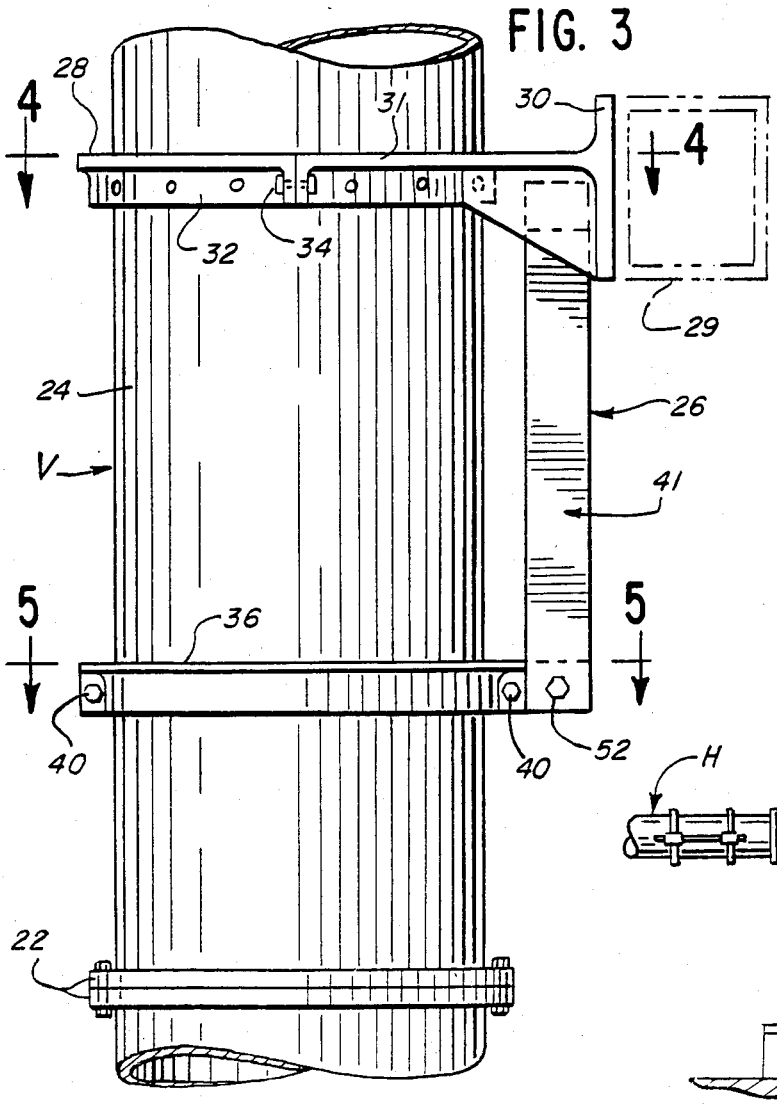
FIG. 3 is a side elevational view of the waveguide hanger shown in FIG. 2 but disposed in engagement with a section of the circular waveguide.

The tower 12 is this instance is of triangular form and fashioned of structural steel. It comprises three main upright members 14, 15, 16 surmounted by a top plate 18 and an antenna 19 connected to the waveguide 11 through appropriate transition sections. Its overall height may be on the order of 1500 feet and it is adapted to support a vertical run V of circular waveguide which may be on the order of 1485 feet in length. The vertical run V, except for the stepped down portion adjacent the 90 degree bend connecting the horizontal run H near the bottom of the tower, may consist of approximately 123 sections 24 (see FIG. 3) of waveguide 11. The sections 24 are each twelve feet in length and bolted together by means of end flanges 22. Each waveguide section 24 in this case is fabricated of aluminum with an outer diameter slightly greater than 15 inches and a peripheral wall thickness on the order of ⅛ inch.

Figure 10:
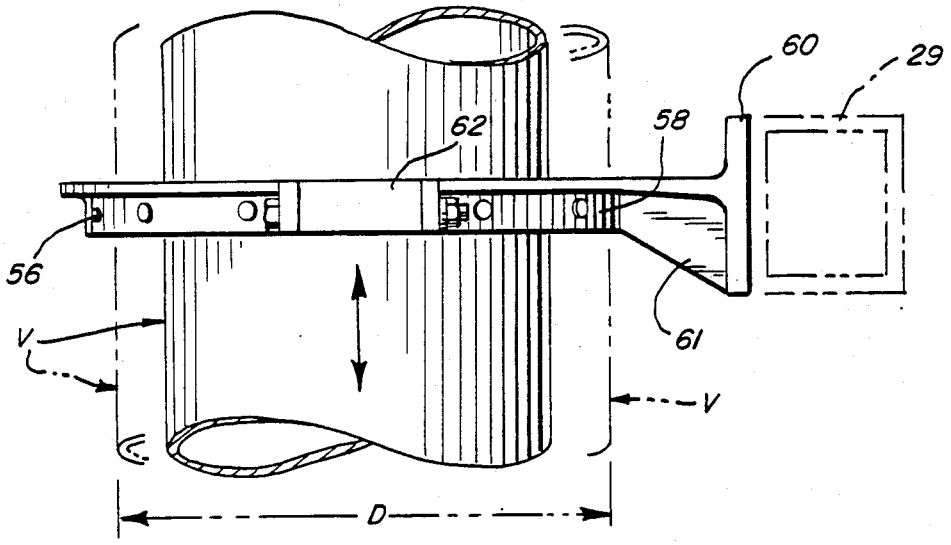
FIG. 10 is an elevational view of the horizontal restrainer bracket shown in FIG. 9 and disposed in engagement with a section of the waveguide.
Figure 9:
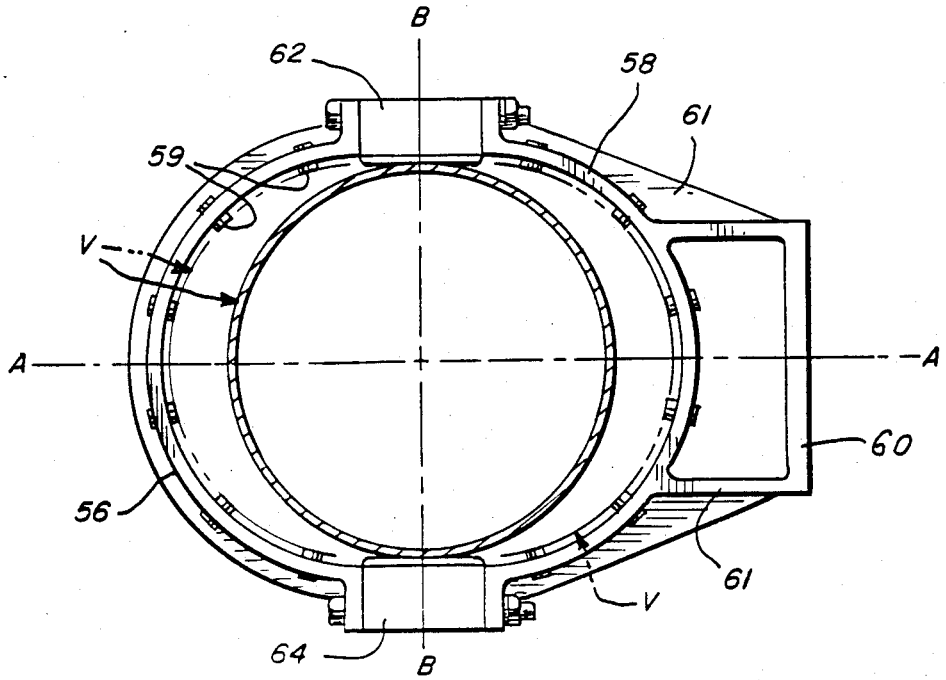
FIG. 9 is a bottom plan view one of the horizontal restrainer brackets mounted at axially spaced intervals in the lower 100 feet of the waveguide.

For approximately the first 100 feet, the vertical run V of waveguide 11 is maintained in alignment by means of a series of horizontal restrainer brackets 25 fixed to the structure of the tower 12 (FIGS. 1, 9 and 10). Although only one horizontal restrainer bracket 25 is shown in diagrammatic FIG. 1, it will be understood that there are five such brackets used in the present tower structure spaced vertically at approximately 20 foot intervals along the waveguide. The spaced brackets 25 permit thermally induced movement of the vertical run V of the waveguide 11 in the vertical direction. They also permit thermally induced horizontal movement of both the lower 100 feet of the vertical run V and the horizontal run H of the waveguide in the common plane defined by the waveguide runs V and H. The brackets 25, however, preclude horizontal movement of the runs V and H normal to such common plane.

For the remaining 1385 feet, the vertical run V of the waveguide is supported by the spring hanger system 10. The latter includes more than 100 vertically spaced spring hangers 26 each interposed between the vertical waveguide run V and the tower structure.

In accordance with the invention, the spring hanger system 10 comprises a plurality of spring hangers 26 (see FIGS. 2 and 3) connected between the vertical waveguide run V and the tower, each hanger being adapted to grip the waveguide with uniform radial pressure in a first region to reinforce same and preclude deformation by point contact pressure in a second region when the hanger resists lateral forces due to wind load. As an incident to such action, the hanger system 10 is adapted to apply sufficient spring force to the waveguide run V to counteract the weight while allowing relative vertical motion of the waveguide with respect to the tower, in this case totaling approximately 22 inches, due to differential expansion. The foregoing is accomplished by the specific construction of the individual spring hangers 26. Since the spring hangers are each of identical construction, a description of one will suffice for all.

Referring more specifically to FIGS. 2 through 8, each spring hanger 26 is adapted to support an adjacent 12 foot section 24 of waveguide. The hanger 26 comprises a glide ring 28 surrounding the waveguide and fixed to a structural member 29 (see FIG. 3) of the tower by means of a mounting flange 30. The glide ring is adapted to restrain the waveguide from motion in all directions except vertical. The portion of the glide ring 28 adjacent to the waveguide is fashioned as a flat flange 31 with a depending circular skirt 32. The ring is preferably made in two halves each having mating tabs which are held together as by assembly bolts 34. The inner diameter of the skirt is somewhat larger than the diameter of the waveguide section 14. Vertical alignment and relative vertical movement between the two are facilitated by a plurality of angularly spaced non-metallic buttons 35 (see FIGS. 4, 7 and 8) on the inner wall of the skirt in sliding contact with the outer peripheral surface of the waveguide. In the present instance, the buttons 35 are formed from NYLON (a long-chain synthetic polymer amide which has recurring amide groups as an integral part of the main polymer chain) plastic material which provides effective bearing contact under wide extremes of temperature.

In order to reinforce the waveguide against deformation when pressed against the glide ring 28 in response to wind load, the spring hanger 26 is provided with a clamping ring 36 connected in depending relation with the glide ring. The clamping ring 36 is of generally L-shaped cross-section, comprising a flat flange 38 and a depending circular skirt 39 (see FIG. 7) precisely machined to engage the outer periphery of the waveguide with a relatively tight fit. The clamping ring may be formed in two halves secured together as by means of tabs and assembly bolts 40.

To transfer the weight of the associated waveguide section 24 to the tower while permitting relative vertical movement of the waveguide, a constant force spring means 41 is interposed between the glide ring 28 and the clamping ring 36 (FIGS. 2, 3, 6, 7). The spring means (see FIGS. 6, 7) in this case comprises a pair of constant force spiral springs 42, 44, wound on laterally spaced wood spools 45, 46. The spools are journalled on fixed shafts 48, 49 projecting horizontally from the mounting flange 30 situated on the underside of the glide ring. The spools and working portions of the springs 42, 44 are protected from the weather by the flat flange 31 of the glide ring and a pair of depending triangular flanges 50, 51 straddling the spool area. In the present instance, the springs 42, 44 are spirally wound in opposite directions and brought downward in a converging path for attachment as by bolt 52 to a radially extending tab 54 on the clamping ring.

The springs 42, 44 are so designed that they tend to remain in their wound spiral position until subjected to a pull-out load, and to return to wound spiral position upon release of the pull-out load. The springs are biased to exert a constant lifting force on the clamping ring on the order of 60 to 80 pounds throughout a deflection of approximately 22 inches. This is sufficient to offset the weight of the associated waveguide section 24 and to exceed the weight of the section by approximately 10 percent. The additional 10 percent bias is taken up by the tower top fixed hanger 55.

Turning next to FIGS. 9 and 10, the specific structure of a horizontal restrainer bracket 25 is there shown. The bracket 25 is similar in construction to the glide ring 28 described earlier herein, comprising a pair of opposed semicircular segments 56, 58 each formed of metal such as aluminum and having a plurality of buttons 59 (see FIG. 9) of NYLON plastic or similar material on its arcuate inside face. Segment 58 has a mounting flange 60 (see FIG. 10) and a pair of underlying reinforcing gussets 61. The bracket 60 may be secured in any suitable manner to adjacent structural member 29 of the tower.

The cross section of the bracket 25, as viewed in FIG. 9, is generally elliptical rather than circular. Its inside diameter along axis A—A in the common plane defined by the waveguide runs V and H is substantially larger than the diameter of the waveguide. This is effected by means of a pair of smooth restrainer blocks 62, 64, which may be formed from aluminum, interposed between the semicircular segments 56, 58. The inside diameter of the bracket 25 along axis B—B which is perpendicular to the common plane of the waveguide runs V and H is approximately equal to the diameter of the waveguide. By the term "approximately" in this case is meant that the inside diameter of the bracket 25 along axis B—B is slightly greater than the waveguide diameter by a small clearance distance.

By reason of the foregoing construction, the bracket 25 permits thermally induced movement of the waveguide run V in a vertical direction, as indicated in FIG. 10. It further permits horizontal movement of the waveguide along axis A—A in the common plane defined by the waveguide runs V and H, as indicated in FIG. 9 and at D in FIG. 10. The bracket 25 precludes horizontal movement of the waveguide along axis B—B runs V and H in a direction perpendicular to such common plane, as indicated in FIG. 9.

It will be appreciated from the foregoing that the spring hanger system described above represents an optimum solution to the problem of supporting large diameter UHF waveguide in transmission towers of any desired height. The system components are simple and reliable in design and economical to manufacture and install. They are easily capable of operating satisfactorily throughout the wide spectrum of weather conditions to which such installations are normally subjected.

I claim as my invention:

1. A spring hanger system for supporting a UHF circular waveguide from a transmission tower and including a plurality of vertically spaced spring hangers attaching said waveguide to said tower, each said hanger comprising, in combination:

(a) a glide ring adapted to be rigidly mounted on said transmission tower and rigidly surrounding the waveguide to restrain the waveguide from motion in all directions except vertical;

(b) a clamping ring vertically spaced from said glide ring and having a circular face adapted to grip the outer peripheral surface of the waveguide tightly while precluding deformation of the waveguide when the hanger resists lateral forces caused by wind loading; and (c) constant force spring means connected between said glide ring and said clamping ring for transferring a portion of the weight of the waveguide to the structure of said transmission tower.

2. The combination set forth in claim 1, wherein said glide ring is a solid of revolution having a generally hollow cylindrical shape having an inner face with a diameter substantially larger than that of the outer face of the circular waveguide, and bearing means for centering the waveguide in said glide ring.

3. The combination defined in claim 2, wherein said bearing means comprises a plurality of heat resistant plastic buttons circumferentially spaced around the inner face of said glide ring.

4. The combination set forth in claim 1, wherein said glide ring is fashioned as a horizontal flange having a circular inner edge with a circular skirt extending downwardly from the inner edge of said flange and having an inner diameter substantially larger than that of the circular waveguide, and non-metallic bearing means disposed in circumferentially spaced relation between said skirt and the waveguide.

5. The combination defined in claim 1, wherein said clamping ring comprises a horizontal flange having a circular inner edge with a circular skirt extending downwardly from the inner edge of said flange and having an inner diameter enabling said ring to grip the circular waveguide tightly without distorting same and thereby stiffen the waveguide in the region of said guide ring.

6. The combination defined in claim 5, in which said clamping ring is formed in two halves adapted to grip the waveguide when bolted together around the waveguide, said clamping ring having a generally radial tab adapted for connection to said spring means.

7. The combination set forth in claim 1, wherein said spring means comprises at least one constant force spiral spring interposed between said glide ring and said clamp ring and adapted to distribute the weight of a section of said waveguide between a pair of successive hangers to said tower.

8. The combination recited in claim 1 wherein said spring means comprises a pair of constant force spiral springs mounted on spools journaled on said glide ring and connected to said clamping ring so as to distribute the weight of a section of said waveguide between a pair of successive hangers to said tower.

9. The combination set forth in claim 1 in which said glide ring has a horizontal flange having a circular inner edge with a circular skirt extending downwardly from the inner edge of said horizontal flange for restraining the waveguide against movement other than vertical; said horizontal flange extending radially outwardly from said circular skirt and terminating in a upright mounting flange engageable with the tower structure; a pair of laterally spaced flanges connected to said horizontal flange beneath said horizontal flange and extending between said skirt and said mounting flange; and a pair of constant force spiral springs comprising two said spring means connected in an adjacent opposite parallel relation mounted on spools situated in the space between said laterally spaced flanges, said mounting flange and said skirt, said spiral springs being connected to said clamping ring.

* * * * *